US012060763B2

(12) United States Patent
Patil et al.

(10) Patent No.: US 12,060,763 B2
(45) Date of Patent: Aug. 13, 2024

(54) CEMENTING APPARATUS FOR REVERSE CEMENTING

(71) Applicant: Halliburton Energy Services, Inc., Houston, TX (US)

(72) Inventors: Ishwar Dilip Patil, Spring, TX (US); Handoko Tirto Santoso, Houston, TX (US); Lonnie Carl Helms, Humble, TX (US); Jinhua Cao, Humble, TX (US); Frank Vinicio Acosta, Spring, TX (US); Mayur Narain Ahuja, Friendswood, TX (US); Rajesh Parameshwaraiah, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/236,792

(22) Filed: Aug. 22, 2023

(65) Prior Publication Data

US 2023/0399918 A1 Dec. 14, 2023

Related U.S. Application Data

(62) Division of application No. 17/088,096, filed on Nov. 3, 2020, now Pat. No. 11,746,618.

(51) Int. Cl.
*E21B 33/14* (2006.01)

(52) U.S. Cl.
CPC ..... *E21B 33/14* (2013.01)

(58) Field of Classification Search
CPC ..... E21B 33/00
See application file for complete search history.

(56) References Cited

U.S. PATENT DOCUMENTS

| | | | | |
|---|---|---|---|---|
| RE29,830 | E * | 11/1978 | Scott | E21B 33/076 166/155 |
| 4,687,019 | A * | 8/1987 | Mayfield | F16K 31/20 137/516.29 |
| 5,494,107 | A | 2/1996 | Bode | |
| 5,765,641 | A | 6/1998 | Shy et al. | |
| 6,026,903 | A | 2/2000 | Shy et al. | |
| 9,441,446 | B2 | 9/2016 | Fripp et al. | |
| 2008/0135248 | A1 | 6/2008 | Talley et al. | |
| 2009/0151960 | A1 | 6/2009 | Rogers et al. | |
| 2013/0255943 | A1 | 10/2013 | Yeh et al. | |

FOREIGN PATENT DOCUMENTS

| | | | |
|---|---|---|---|
| CN | 108301788 | A | 7/2018 |

* cited by examiner

*Primary Examiner* — William D Hutton, Jr.
*Assistant Examiner* — Avi T Skaist
(74) *Attorney, Agent, or Firm* — John Wustenberg; Parker Justiss, P.C.

(57) ABSTRACT

Provided, in one aspect, is a cementing apparatus. The cementing apparatus, in one embodiment comprising a housing; a fixed member coupled with the housing, the fixed member having at least one fixed member fluid opening therein; and a moving member positioned downhole of the fixed member and movable between a circulating position and a cemented position, the moving member having at least one moving member fluid opening therein, the at least one moving member fluid opening linearly offset from the at least one fixed member fluid opening.

20 Claims, 12 Drawing Sheets

CEMENTING APPARATUS FOR REVERSE CEMENTING

This Application is a Divisional of prior application Ser. No. 17/088,096 filed on Nov. 3, 2020, entitled "CEMENTING APPARATUS FOR REVERSE CEMENTING". The above-listed Application is commonly assigned with the present invention and is incorporated herein by reference as if reproduced herein in its entirety.

BACKGROUND

Cement may be used in a variety of subterranean oil and gas operations. For example, in subterranean well construction, a casing (e.g., pipe string, liners, expandable tubulars, etc.) may be run into a wellbore and cemented in place. The process of cementing the casing in place is commonly referred to as "primary cementing." In a typical primary cementing method, a cement slurry may be pumped into an annulus between the walls of the wellbore and the exterior surface of the casing disposed therein. The cement slurry is traditionally pumped down the casing and then back up the aforementioned annulus. The cement slurry may set in the annular space, thereby forming an annular sheath of hardened, substantially impermeable cement that may support and position the casing in the wellbore and may bond the exterior surface of the casing to the subterranean formation. Among other things, the hardened cement surrounding the casing functions to prevent the migration of fluids in the annulus, as well as protecting the casing from corrosion.

BRIEF DESCRIPTION

Reference is now made to the following descriptions taken in conjunction with the accompanying drawings, in which.

DETAILED DESCRIPTION

Figure 1:
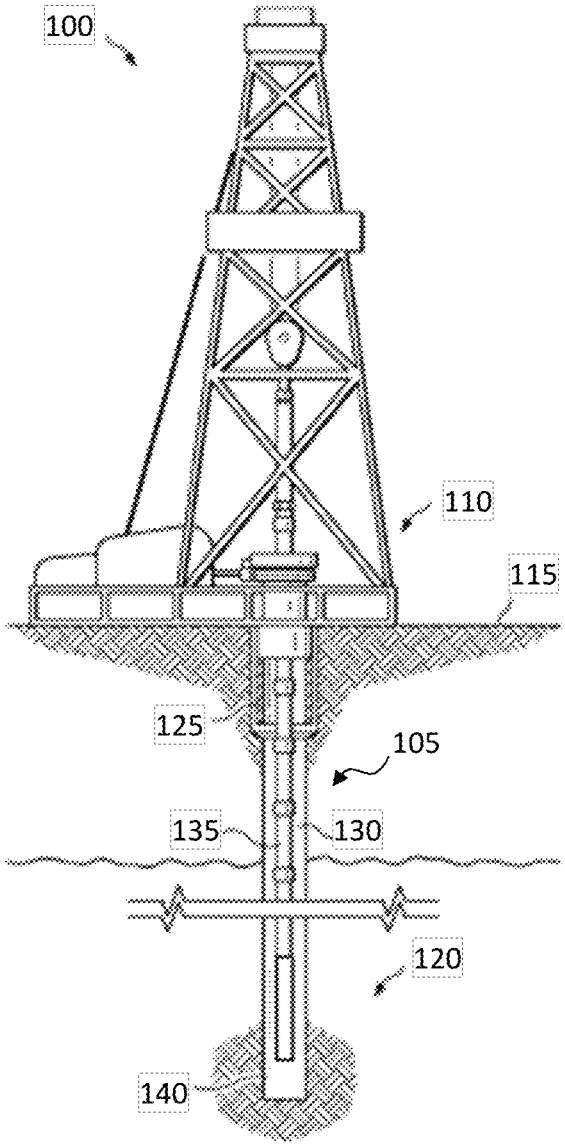
FIG. 1 illustrates one embodiment of a wellbore having a cementing apparatus placed therein according to one or more aspects of the disclosure.

The present disclosure recognizes that traditional cementing methods, such as the "primary cementing" described above, present various challenges when completing a wellbore. One such challenge relates to the difficulty in determining when the cement slurry has reached a desired or required level inside the annulus between the walls of the wellbore and the exterior surface of the casing disposed therein. In addition, by pumping the cement slurry down the casing and back up the annulus between the walls of the wellbore and the exterior surface of the casing, debris and sediment may collect within the casing, which ultimately must be cleaned. Further, traditional cementing methods may require additional trips down into the wellbore to retrieve tooling used in the "primary cementing" process. Embodiments of a cementing apparatus disclosed herein are presented to address one or more of the foregoing challenges.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Furthermore, unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Additionally, unless otherwise specified, use of the term "subterranean formation" shall be construed as encompassing both areas below exposed earth and areas below earth covered by water such as ocean or fresh water.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, at least about 99% met, or even at least about 100% met.

Referring now to FIG. 1, there is shown one embodiment of a well system 100. The well system 100 generally includes a substantially cylindrical wellbore 105 that extends from a wellhead 110 at the surface 115 downward into the Earth and into one or more subterranean zones of interest 120 (one shown). The subterranean zone 120 may correspond to a single formation, a portion of a formation, or more than one formation accessed by the well system 100, and a given well system 100 can access one, or more than one, subterranean zone 120.

A portion of the wellbore 105 extending from the wellhead 110 to the subterranean zone 120 may be lined with lengths of casing 125 (e.g., pipe string, liners, expandable tubulars, etc.). An annulus 130 may exist between the casing 125 and the wellbore 105. The depicted well system 100 is a vertical well, with the wellbore 105 extending substantially vertically from the surface 115 to the subterranean zone 120. The concepts herein, however, may apply to many other different configurations of wells, including horizontal, slanted or otherwise deviated wells, and multilateral wells with legs deviating from an entry well.

A drill string 135 is shown as having been lowered from the surface 115 into the wellbore 105. In some instances, the drill string 135 may include a series of jointed lengths of tubing coupled together end-to-end and/or a continuous (i.e., not jointed) coiled tubing. The drill string 135 may include one or more well tools. In some embodiments, the one or more tools may include a cementing apparatus 140. The cementing apparatus 140 may include a housing coupled to or, in some embodiments, comprise a portion of the casing 125. The cementing apparatus 140, according to one or more embodiments of the disclosure, may include a fixed member positioned within the housing, the fixed member having at least one fixed member fluid opening therein. The cementing apparatus 140 may additionally include a moving member positioned downhole of the fixed member. The moving member may include at least one moving member fluid opening, which may be linearly offset from the at least one fixed member fluid opening. In one or more embodiments, the moving member may be movable between a fluid circulating position and a cemented position (e.g., fully cemented position). Prior to the cementing process, drill fluid, or a micro fluid may be inserted into the casing 125 and displaced out into the annulus 130 to clean and condition an interior of the casing 130. The drill fluid may flow freely through the at least one fixed member fluid opening or the at least one moving member fluid opening, often travelling through a float collar or float shoe prior to entering the cementing apparatus 140.

Cement slurry may be inserted into the annulus 130 and once the cement slurry reaches a bottom most point of the wellbore 105, the cement slurry may then move at least partially uphole into the housing of the cementing apparatus 140. The cement slurry may then flow uphole through the at least one moving member fluid opening, wherein the viscous cement slurry may move the moving member uphole from the circulating position towards the fixed member until the moving member seats near or against the fixed member in the cemented position. A rise in pressure at the surface 115 may indicate when the moving member has reached engagement with the fixed member, such that the annulus is full of cement slurry and thus no more cement slurry needs to be inserted into the annulus 130 of the wellbore 105. After a prescribed period of time, the cement slurry will harden into a solid cement sheath. Once placed into the wellbore 105, the cementing apparatus 140 may not need to be retrieved, so an additional trip into the wellbore with the drill string 135 may not be required in certain embodiments.

Figure 2A:
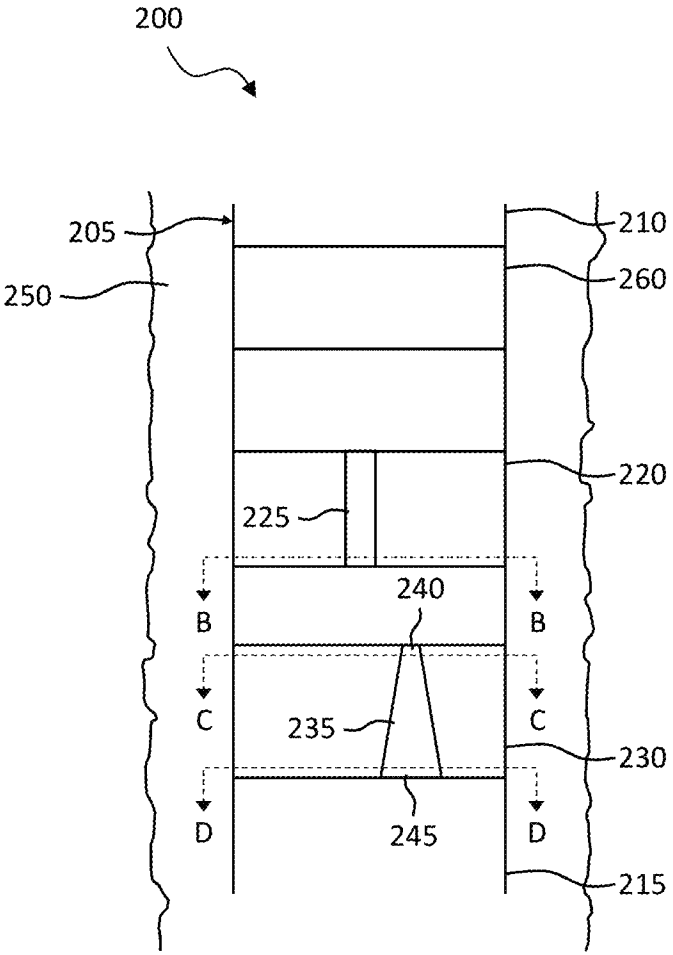
FIG. 2A illustrates of one embodiment of a cementing apparatus, manufactured and operated according to one or more aspects of the disclosure which may be used in a well system, such as the well system shown in FIG. 1.

Referring now to FIG. 2A, there is one embodiment of a cementing apparatus 200, which may be used in a well system, such as the well system 100 shown in FIG. 1. The cementing apparatus 200 may include a housing 205. The housing 205 may have an uphole end 210 and a downhole end 215, wherein the downhole end 215 may be proximal with a downhole most portion of the wellbore and as such, proximal a downhole most end of the wellbore casing (e.g., the casing 125 shown in FIG. 1). In some embodiments, the housing 205 may be coupled at its uphole end 210 with a portion of a wellbore casing or, in some embodiments, may comprise a portion of the wellbore casing. Accordingly, in certain embodiments the housing 205 comprises steel.

In accordance with one embodiment of the disclosure, the cementing apparatus 200 may include a fixed member 220 coupled with the housing 205. The fixed member 220, in some embodiments, may be a fixed sleeve threaded with the housing 205. The fixed member 220 may include at least one fixed member fluid opening 225 or fluid passageway therein, the at least one fixed member fluid opening 225 enabling drilling fluid and/or microfluids to pass downhole there through. In certain embodiments, such as that shown, the fixed member fluid openings 225 are straight holes in the fixed member 220

In accordance with one or more embodiments, the cementing apparatus 200 may additionally include a moving member 230 positioned downhole of the fixed member 220. In one or more embodiments, the moving member 230 may be sliding sleeve. In certain embodiments, the moving member 230 may have an outer diameter smaller than an inner diameter of the housing 205 such that the moving member 230 may slide in both an uphole and downhole direction within the housing 205 relative to the fixed member 220. The moving member 230 may include, in one or more embodiments, at least one moving member fluid opening 235 therein. In some embodiments, the at least one moving member fluid opening 235 may be linearly offset from the at least one fixed member fluid opening 225. In some embodiments, the at least one moving member fluid opening 235 may also be radially offset from the at least one fixed member fluid opening 225. In this embodiment, the at least one moving member fluid opening 235 may have an uphole cross-section area 240 and a downhole cross-section area 245. In some embodiments, the downhole cross-section area 245 may be larger than the uphole cross-section area 240, such that the at least one moving member fluid opening 235 may have an inverted taper or conical shape. In some embodiments, the downhole cross-section area 245 may be at least 50% larger than the uphole cross-section area 240, and in some embodiments, the downhole cross-section area 245 may be up to at least 200% larger than the uphole cross-section area 240. Other embodiments may include varying sizes and ratios of the downhole cross-section area 245 and the uphole cross-section area 240, and as such the at least one moving member fluid opening 235 may have various shapes and forms.

In some embodiments, the moving member 230 may be movable between a circulating position, wherein drilling fluid and other fluids may pass in a downhole direction through the at least one fixed member fluid opening 225 and the at least one moving member fluid opening 235. Once the drilling or microfluids reaches the downhole end 215 of the housing 205, the fluid may then be displaced radially outward and into an annulus 250 surrounding the housing 205. During a cementing process (e.g., reverse cementing process), the moving member 230 may move from the circulating position to a cemented position. The cemented position is typically achieved when the cement slurry has filled the annulus 250. For example, once the cement slurry has filled the annulus 250, and flows uphole toward and through the at least one moving member fluid opening 235, the viscous cement slurry moves the moving member 230 uphole toward the fixed member 220 until the moving member 230 seats proximal to or against the fixed member 220. As the at least one moving member fluid opening 235 may be linearly and/or radially offset from the at least one fixed member fluid opening 225, the fluid passageway is closed and the cement slurry cannot pass through the fixed member 220 uphole and further into the housing 205 and/or wellbore casing.

In some embodiments, the housing 205 may further comprise a float device 260, which in some embodiments may function as a check valve as the cementing apparatus 200 is inserted downhole into the wellbore. In one or more embodiments, the float device replaces what is traditionally called a float shoe or float collar. By ending the reverse flow of cement at the conclusion of the job, the float device will act as a check valve to prevent further flow of the cement up the casing string.

Figure 2B:
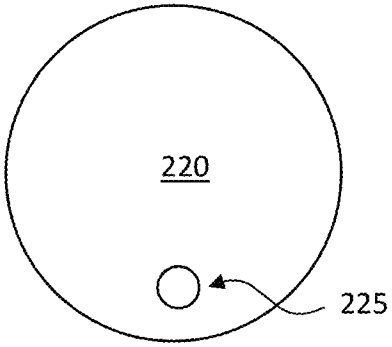
FIG. 2B is a view of a fixed member of the cementing apparatus shown in FIG. 2A.
Figure 2D:
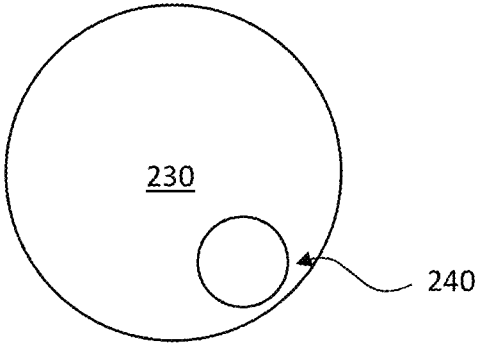
FIG. 2D is a view of a downhole side of the moving member of the cementing apparatus shown in FIG. 2A.
Figure 2C:
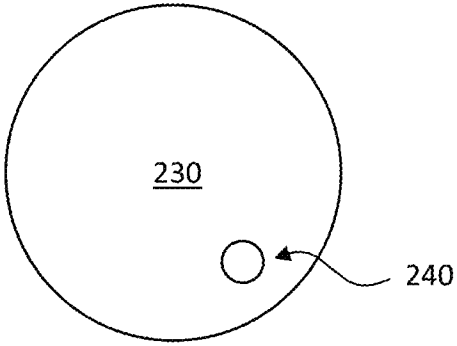
FIG. 2C is a view of an uphole side of a moving member of the cementing apparatus shown in FIG. 2A.

Referring now to FIGS. 2B through 2D, illustrated are various different cross-sectional views of the cementing apparatus shown in FIG. 2A taken through lines B-B, C-C, and D-D, respectively. With initial reference to FIG. 2B the at least one fixed member fluid opening 225, in this embodiment, is positioned within an outer perimeter of the fixed member 220. Nevertheless, the fixed member fluid opening 225 may be positioned at many other positions sufficient to enable fluid flow through the fixed member 220. With reference to FIG. 2C, the uphole cross-section area 240 is positioned within an outer perimeter of the sliding member 230, but again may be positioned at many other positions sufficient to enable fluid flow through the sliding member 230. With reference to FIG. 2D, the downhole cross-section area 245 is positioned within an outer perimeter of the sliding member 230, but again may be positioned at many other positions sufficient to enable fluid flow through the sliding member 230. As is illustrated in the embodiment of FIGS. 2C and 2D, the downhole cross-section area 245 is larger than the uphole cross-section area 240. Furthermore, the uphole cross-section area 245 is linearly offset, and in the embodiment of FIGS. 2B through 2C, radially offset from the fixed member fluid opening 225. Thus, as the cement slurry flows uphole through the at least one moving member fluid opening 235, the uphole cross-section area 240 may eventually be sealed against the fixed member 220 as the moving member 230 seats proximal to or against the fixed member 220.

Figure 3B:
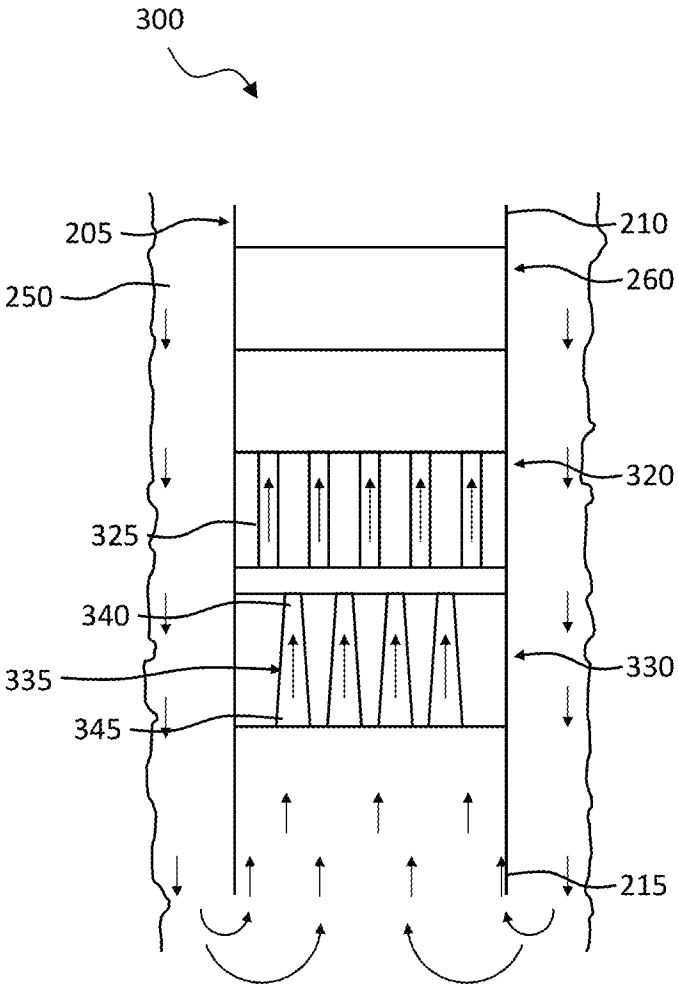
FIG. 3B illustrates the cementing apparatus of FIG. 3A in a reverse cementing operational state.
Figure 3A:
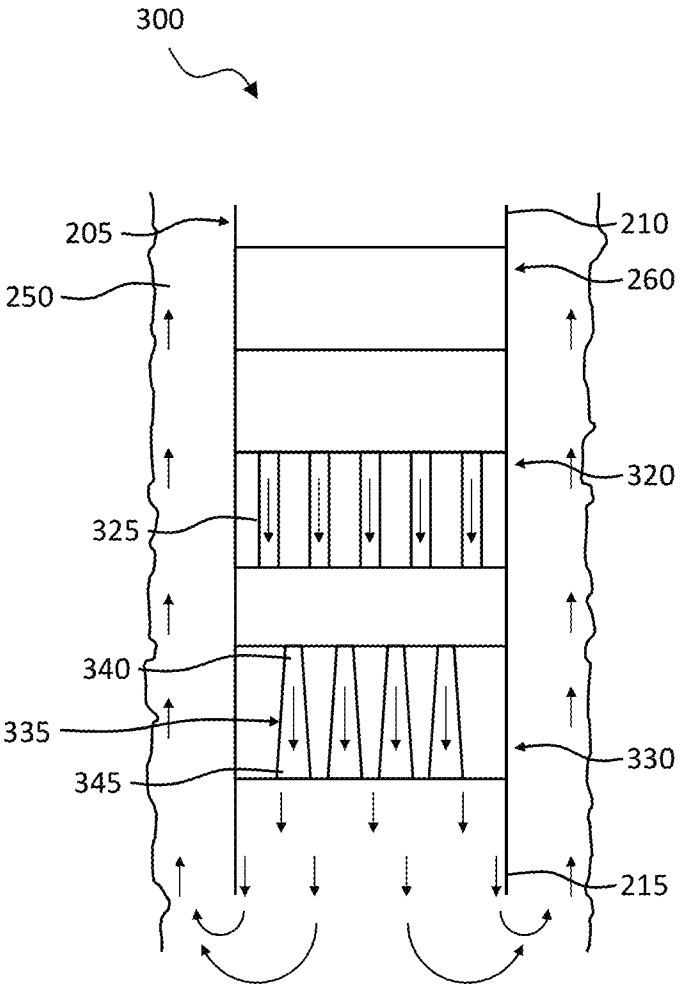
FIG. 3A illustrates another embodiment of a cementing apparatus designed, manufactured and operated according to one or more aspects of the disclosure shown in a run-in-hole operational state.
Figure 3C:
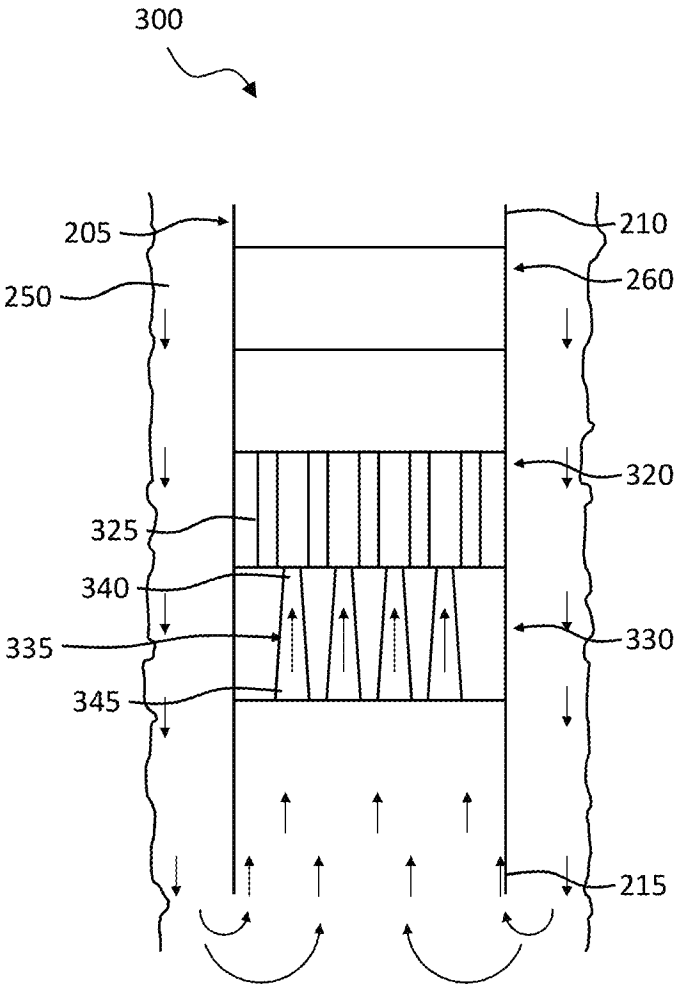
FIG. 3C illustrates the cementing apparatus of FIG. 3A near completion of reverse cementing operational state.

Referring now to FIGS. 3A through 3C, illustrated are various cross-sectional views of a cementing apparatus 300 designed, manufactured and operated according to one or more aspects of the disclosure at various different operational states. The cementing apparatus 300 is similar in many respects to the cementing apparatus 200 of FIGS. 2A through 2D. Accordingly, like reference numbers have been used to reference similar, if not identical, features. The cementing apparatus 300 differs, for the most part, from the cementing apparatus 200, in that the fixed member 320 has a plurality of moving member fluid openings 335, and the moving member 330 has a plurality of moving member fluid openings 335. In this embodiment, similar to cementing apparatus 200, the plurality of moving member fluid openings 335 may be linearly offset from the plurality of fixed member fluid openings 325. Similarly, the plurality of moving member fluid openings 335 may each have an uphole cross-section area 340 and a downhole cross-section area 345, wherein the downhole cross-section area 345 is larger than the uphole cross-section area 340.

FIG. 3A illustrates the cementing apparatus 300 in a run-in-hole operational state, and in certain embodiments a drilling or fluid circulating operational state. The sliding sleeve 330, at this operational state, is in the circulating position, and thus set apart from the fixed member 320. Once the cementing apparatus 300 is run-in-hole, drilling fluid or other microfluids may be inserted into the wellbore and flow downhole through the casing and the housing 205, through the plurality of fixed member fluid openings 325 and into the plurality of moving member fluid openings 335. When the fluid reaches the downhole end 215 of the housing 205, it may then turn radially outward and flows uphole into the annulus 250, and in certain situations out of the wellbore. This operational state may be used to clean and clear debris from within the wellbore casing.

FIG. 3B illustrates the cementing apparatus 300 in a cementing (e.g., reverse cementing) operational state. Cement slurry may be inserted into the annulus 250 from uphole. When the cement slurry reaches the downhole end 215 of the housing 205, the cement slurry may enter the housing 205 and turn uphole. As the cement slurry flows through the plurality of moving member fluid openings 335, the cement slurry combined with the shape of the plurality of moving member fluid openings 335 causes the sliding sleeve 330 to slide in an uphole direction toward the fixed sleeve 320.

FIG. 3C illustrates the cementing apparatus 300 at (or near) the completion of the cementing operational state, and thus the sliding sleeve 330 is in the cemented position. As the sliding sleeve 330 reaches the fixed sleeve 320, the cement slurry may substantially fill the plurality of moving member fluid openings 335 and the sliding sleeve 330 may seat proximal to or against the fixed sleeve 320. As the plurality of moving member fluid openings 335 are linearly offset from plurality of fixed member fluid openings 325, cement may not flow through the fixed sleeve 320 once the sliding sleeve 330 is seated proximal to or against the fixed sleeve 320. In some embodiments, a pressure indicator or gauge may be located at a surface of the wellbore. When the sliding sleeve 330 seats proximal to or against the fixed sleeve 320, a rise in pressure may be sensed with the pressure indicator such that operators at the surface may stop inserting cement slurry into the annulus 250. The cementing process is complete, in this embodiment, once the cement cures within the annulus 250, and in certain embodiments within the downhole end 215 of the housing 205.

Figure 4A:
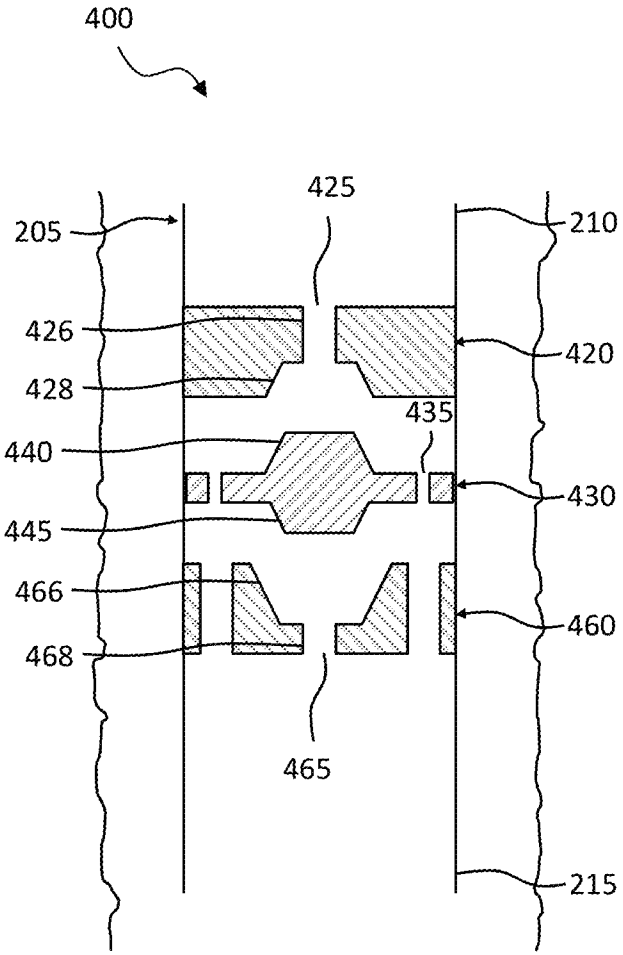
FIG. 4A illustrates of one embodiment of a cementing apparatus designed, manufactured and operated according to one or more aspects of the disclosure which may be used in embodiments of the wellbore shown in FIG. 1.

FIG. 4A illustrates a cross-section view of one embodiment of a cementing apparatus 400 designed, manufactured and operated according to one or more other aspects of the disclosure. The cementing apparatus 400 is similar in many respects to the cementing apparatus 300 of FIGS. 3A-3C. Accordingly, like reference numbers have been used to reference similar, if not identical, features. The cementing apparatus 400 differs, for the most part, from the cementing apparatus 300, in that a first fixed member 420 may have a fixed member fluid opening 425, in this embodiment, near a radial center thereof. The fixed member fluid opening 425, in this embodiment, may have an uphole profile 426 and a downhole profile 428. In certain embodiments, the downhole profile 428 may be larger relative to the uphole profile 426. The cementing apparatus 400 may additionally include a second fixed member 460 coupled to the housing 205 downhole of the first fixed member 420. The second fixed member 460 may similarly include a fixed member fluid opening 465 therein, and in this embodiment, may be positioned near a radial center thereof, and similarly include at least an uphole profile 466, and possibly a downhole profile 468. In certain embodiments, the first fixed member 420 and the second fixed member 460 are threadingly fixed with the housing 205.

The moving member, in this embodiment, may be a floating plug 430 positioned within the housing 205 between the first and second fixed members 420 and 460. The floating plug 430, in some embodiments, may have an uphole profile 440 that fits with and seals against the downhole profile 428 of the first fixed member 420. In certain embodiments, the downhole profile 428 is similarly shaped to the uphole profile 440. In some embodiments, the floating plug 430 may further include a downhole profile 445 that in some embodiments may fit with a similarly shaped uphole profile 466 of the second fixed member 460. Accordingly, the floating plug 430, in this embodiment, may move freely within the housing 205 between the first and second fixed members 420 and 460.

The floating plug 430 may comprise many different materials and remain within the scope of the disclosure. Nevertheless, in one embodiment, the material chosen for the floating plug is based at least in part on Archimedes principles, for example that less dense materials float on denser fluids, whereas more dense materials sink in lighter fluids. With this principle in mind, the material of the floating plug may be chosen such that the floating plug 430 is denser than the drilling and/or circulating fluid, but is less dense than the cement slurry. In such an embodiment, the floating plug 430 would sink when in contact with the drilling and/or circulating fluid, but would float when in contact with the cement slurry. Accordingly, in one embodiment at least a portion of the floating plug 430 might comprise a lighter metal, thermoplastic, thermoset plastic, a high duro elastomer, or another acceptable composite material.

Figure 4C:
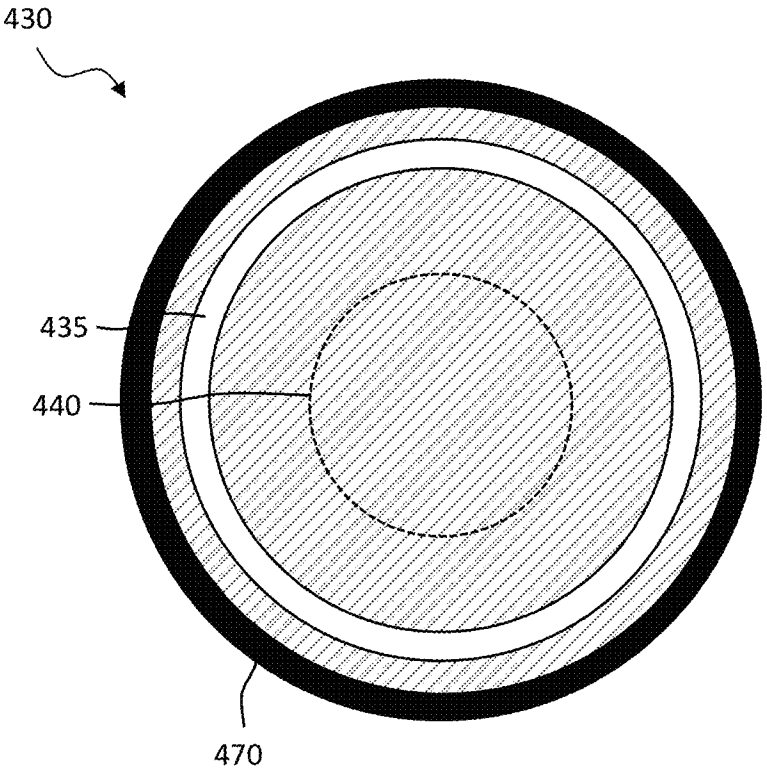
FIG. 4C is a view of an uphole side of the moving member of the cementing apparatus shown in FIG. 4A.
Figure 4B:
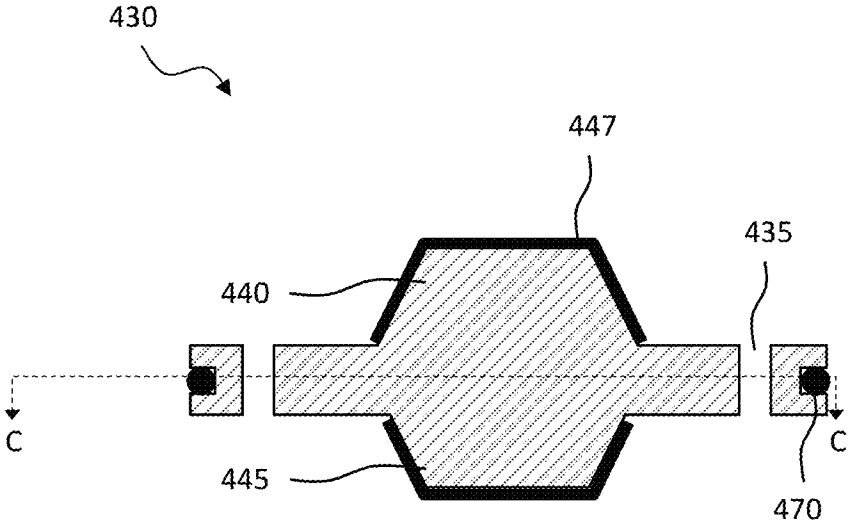
FIG. 4B is a side view of a moving member of the cementing apparatus shown in FIG. 4A.

FIG. 4B is a side view of the floating plug 430. In this embodiment, the floating plug 430 may include an elastomer sealing portion 470, which in this embodiment, may be an O-ring. The sealing portion 470 may serve to both seal fluid from passing around the floating plug 430, but also to enable the floating plug 430 to move freely within an inner diameter of the housing 205. In this embodiment, the uphole profile 440 and downhole profile 445 may be shaped similarly, but there may be other embodiments where the downhole profile 445 may comprise a different shape. For example, the second fixed member 460, in some embodiments, may simply be a side stop or protrusion extending only partially within the housing 205 in order to prevent the floating plug 430 from moving downhole past a desired position, wherein the downhole profile 445 may have an unremarkable shape. Either one or both of the uphole profile 440 or downhole profile 445 may have a sealing member 447. In certain embodiments, the floating plug 430 comprises a material that has inherent sealing properties, and thus the floating plug 430 itself comprises a sealing member 447. In other embodiments, the sealing member 447 is a layer of material having the necessary sealing properties.

FIG. 4C illustrates a cross-sectional view of the floating plug 430 illustrated in FIG. 4B, for example taken through the line C-C in FIG. 4B. The floating plug 430, in this embodiment, may include one or more moving member fluid openings 435 (e.g., one or more cavities or holes) positioned radially about a center (e.g., a phenolic molded center portion) of the floating plug 430 and about the uphole profile 440.

Figure 5B:
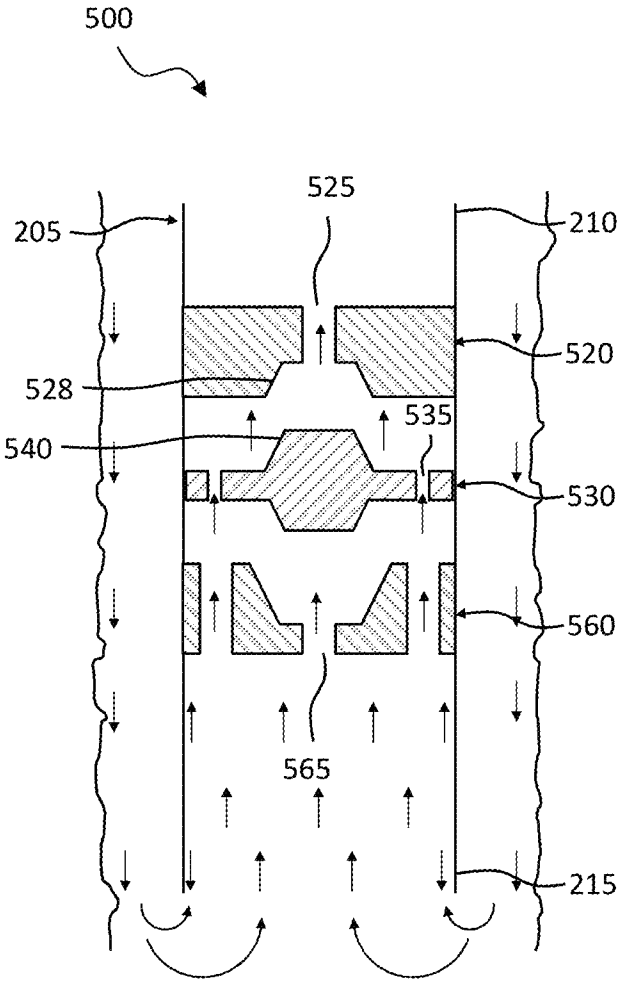
FIG. 5B illustrates the cementing apparatus of FIG. 5A in a reverse cementing operational state.
Figure 5A:
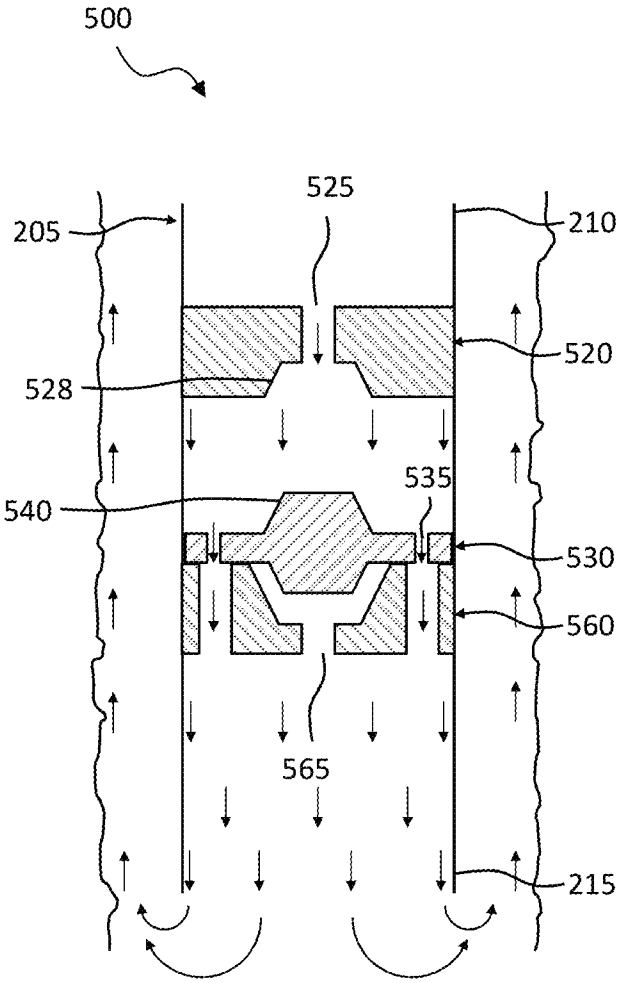
FIG. 5A illustrates another embodiment of a cementing apparatus designed, manufactured and operated according to one or more aspects of the disclosure shown in a run-in-hole operational state.
Figure 5C:
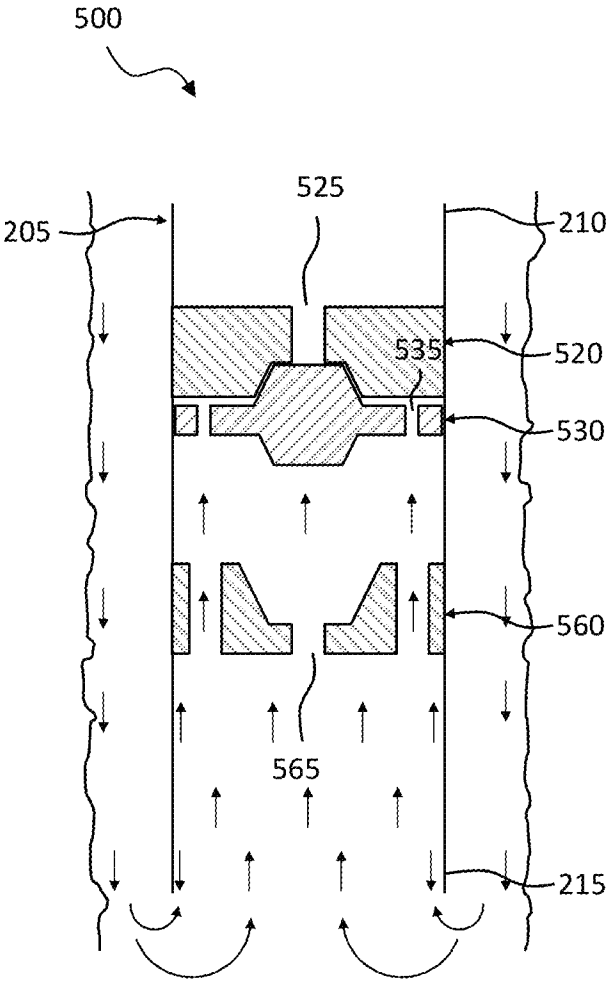
FIG. 5C illustrates the cementing apparatus of FIG. 5A near completion of reverse cementing operational state in a drilling operational state.

Referring now to FIGS. 5A through 5C, illustrated are various cross-sectional views of a cementing apparatus 500 designed, manufactured and operated according to one or more aspects of the disclosure are various different operational states. The cementing apparatus 500 is similar in many respects to the cementing apparatus 400 of FIGS. 4A through 4C. Accordingly, like reference numbers have been used to reference similar, if not identical, features.

FIG. 5A illustrates the cementing apparatus 500 in a run-in-hole operational state, which may be similar to a drilling operational state. Drilling fluid and/or circulating fluid is inserted into the casing, and in this embodiment, the housing 205, and flows downhole through a fixed member fluid opening 525 of the first fixed member 520, through the one or more moving member fluid openings 535 of the moving member 530, and then through a fixed member fluid opening 565 of a second fixed member 560. As the moving member 530 comprises a material having a density greater than the drilling fluid and/or circulating fluid, the moving member 530 tends to sink toward the second fixed member 560.

FIG. 5B illustrates the cementing apparatus 500 in a cementing operational state. As cement slurry flows uphole into the housing 205, the cement slurry flows uphole through the fixed member fluid opening 565 of the second fixed member 560. As the moving member 530 comprises a material having a density less than the cement slurry, the moving member tends to float upward toward the first fixed member 520. Also, as the surface area of the floating plug 530 is significantly greater than the cross-sectional area of the one or more moving member fluid openings 535, the floating plug 530 is additionally urged uphole by the cement slurry. FIG. 5C illustrates the cementing apparatus of FIG. 5A at or near completion of the cementing operational state. As the floating plug 530 moves uphole toward the first fixed member 520, an uphole profile 540 of the floating plug 530 may seat into and seal within a downhole profile 528 of the first fixed member 520, which may stop any further flow of cement uphole beyond the first fixed member 520. The aforementioned sealing member may additionally help in forming a good seal.

Figure 6:
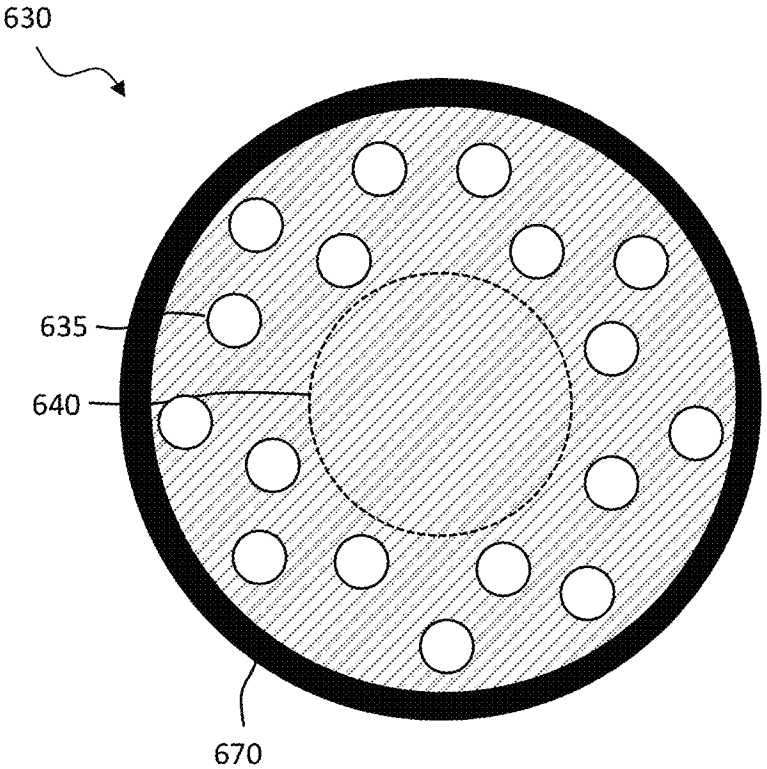
FIG. 6 illustrates another embodiment of a moving member which may be used with an embodiment of a cementing apparatus designed, manufactured and operated according to one or more aspects of the disclosure.

FIG. 6 illustrates another embodiment of a moving member 630 which may be used with an embodiment of a cementing apparatus designed, manufactured and operated according to one or more aspects of the disclosure. The moving member 630 is similar in many respects to the floating plug 430 of FIGS. 4A-4C. Accordingly, like reference numbers have been used to reference similar, if not identical, features. The moving member 630 differs, for the most part, from the floating plug 430, in that the moving member 630 includes a plurality of moving member fluid openings 635 positioned radially about an uphole profile 640 near a center of the moving member 630.

Figure 7B:
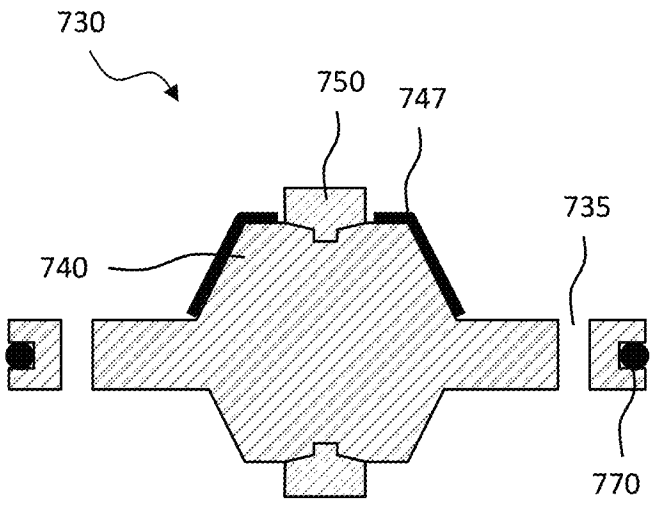
FIG. 7B illustrates a moving mechanism which may be used in the cementing apparatus shown in FIG. 7A.
Figure 7A:
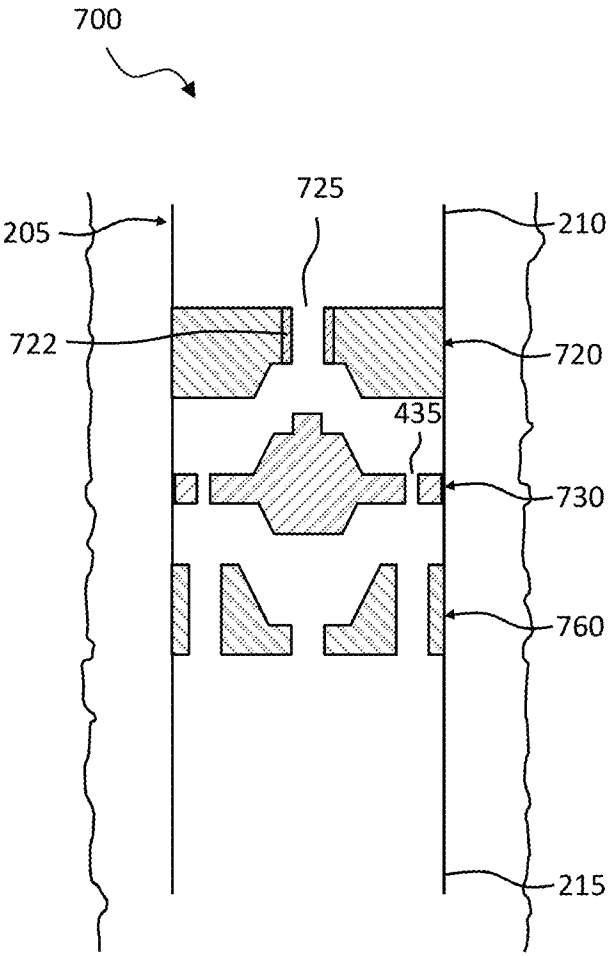
FIG. 7A illustrates yet another embodiment of a cementing apparatus designed, manufactured and operated according to one or more aspects of the disclosure.

FIG. 7A illustrates yet another embodiment of a cementing apparatus 700 designed, manufactured and operated according to one or more aspects of the disclosure. The cementing apparatus 700 is similar in many respects to the cementing apparatus 500 of FIGS. 5A-5C. Accordingly, like reference numbers have been used to reference similar, if not identical, features. The cementing apparatus 700 differs, for the most part, from the cementing apparatus 500, in that a first fixed member 720 may include a magnet or magnetic surface 722 placed proximal to or within a fixed member fluid opening 725.

FIG. 7B illustrates one embodiment of a floating plug 730 which may be used in the cementing apparatus shown in FIG. 7A. The floating plug 730, in this embodiment, may include a moving member magnet or magnetic surface 750 on or above an uphole profile 740 of the floating plug 730. In one or more embodiments, the magnetic surface is molded with the uphole profile 740, or alternatively screwed into the uphole profile 740. Similar to floating plug 430 of FIG. 4B, the floating plug 730 may additionally include an elastomer sealing portion 770 and a sealing member 747 positioned about the floating plug 730. In this embodiment, a magnetic bond between the magnetic surface 722 of the fixed member 720 and the magnetic surface 750 of the floating plug 730 may help hold the floating plug 730 in an engaged position with the fixed member 720 while the cement slurry is curing.

Figure 8B:
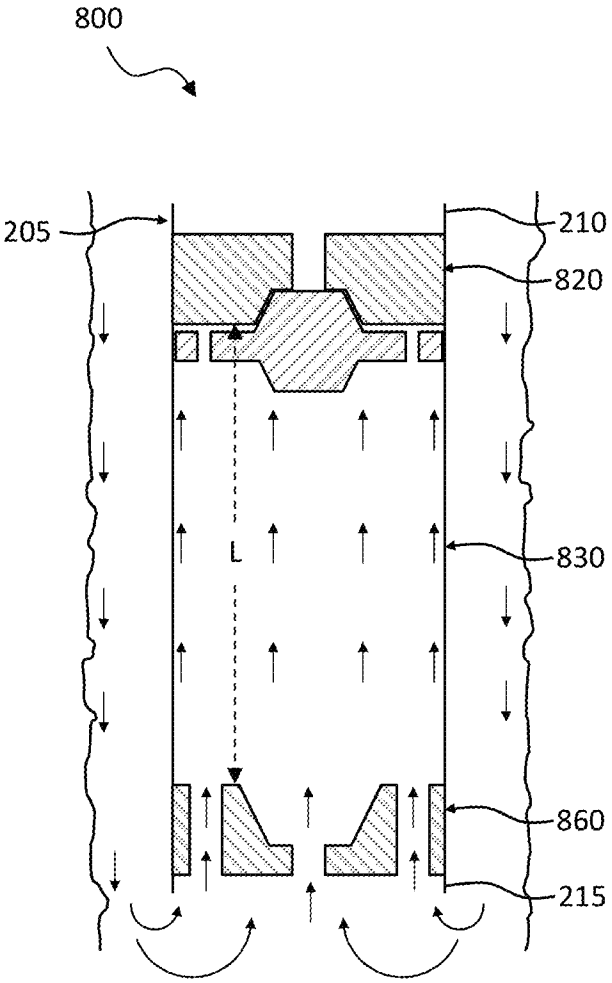
FIG. 8B illustrates the cementing apparatus of FIG. 8A in a reverse cementing operational state.
Figure 8A:
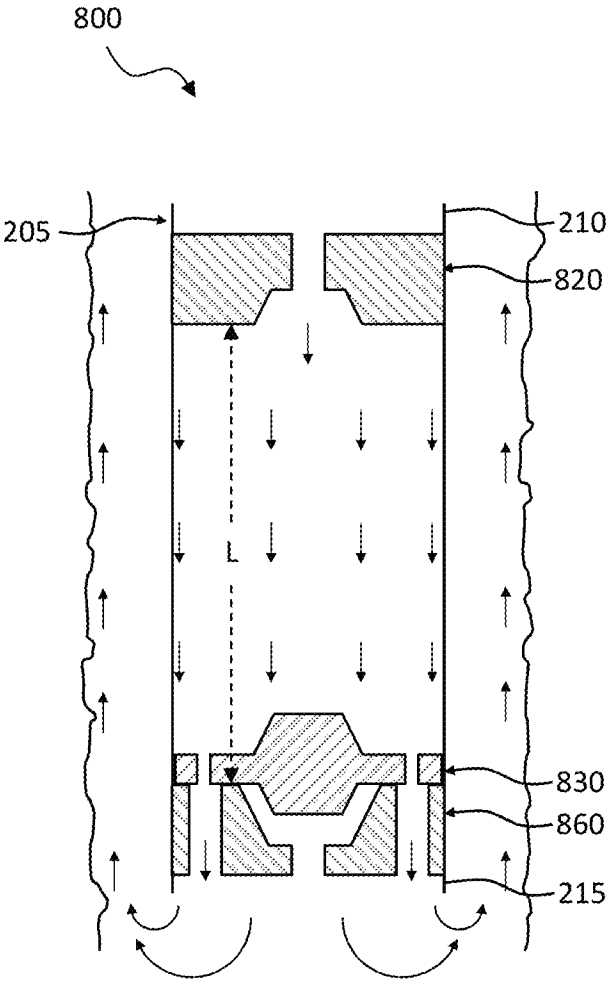
FIG. 8A illustrates yet another embodiment of a cementing apparatus designed, manufactured and operated according to one or more aspects of the disclosure, shown in a run-in-hole operational state.

FIG. 8A illustrates yet another embodiment of a cementing apparatus 800 designed, manufactured and operated according to one or more aspects of the disclosure, shown in a run-in-hole and drilling operational state. The cementing apparatus 800 is similar in many respects to the cementing apparatus 700 of FIG. 7A. Accordingly, like reference numbers have been used to reference similar, if not identical, features. The cementing apparatus 800 differs, for the most part, from the cementing apparatus 700, in that a first fixed member 820 and a second fixed member 860 may be separated by a significant distance, length (L). The length (L), in certain embodiments is at least 2 meters, in yet other embodiments, is at least 10 meters, in yet other embodiments is at least 15 meters, and in additional embodiments is 30 meters or more. Accordingly, in this embodiment the floating member 830 has a greater distance to travel as it moves between the first fixed member 820 and the second fixed member 860. As such, a floating plug 830 may have a greater distance to move between the first and second fixed members 820 and 860 than in either of the cementing apparatus 500 or 700. In the drilling and/or circulating operational state illustrated in FIG. 8A, the floating member 830 is located proximate the downhole end 215 of housing 205. FIG. 8B illustrates the cementing apparatus of FIG. 8A in a cementing operational state, illustrating the floating plug 830 as it moves uphole and seating against the first fixed member 820.

Aspects disclosed herein include:

Aspect A: A cementing apparatus, comprising: a housing; a fixed member coupled with the housing, the fixed member having at least one fixed member fluid opening therein; and a moving member positioned downhole of the fixed member and movable between a circulating position and a cemented position, the moving member having at least one moving member fluid opening therein, the at least one moving member fluid opening linearly offset from the at least one fixed member fluid opening.

Aspect B: A method for cementing a wellbore; the method comprising: placing a cementing apparatus within a downhole portion of a wellbore, the cementing apparatus, including: a housing; a fixed member coupled with the housing, the fixed member having at least one fixed member fluid opening therein; and a moving member positioned downhole of the fixed member and movable between a circulating position and a cemented position, the moving member having at least one moving member fluid opening therein, the at least one moving member fluid opening linearly offset from the at least one fixed member fluid opening; and pumping cement slurry into an annulus surrounding the wellbore casing until the moving member moves from the circulating position to the cemented position with the moving member seated against the fixed member.

Aspect C: A well system, comprising: a wellbore located within a subterranean formation; and a cementing apparatus placed in a downhole portion of the wellbore via a conveyance, the cementing apparatus including: a housing; a fixed member coupled with the housing, the fixed member having at least one fixed member fluid opening therein; and a moving member positioned downhole of the fixed member and movable between a circulating position and a cemented position, the moving member having at least one moving member fluid opening therein, the at least one moving member fluid opening linearly offset from the at least one fixed member fluid opening.

Aspects A, B, and C may have one or more of the following additional elements in combination:

Element 1: wherein the moving member is a sliding sleeve and the at least one moving member fluid opening has an uphole cross-section area and a downhole cross-section area, wherein the downhole cross-section area is larger than the uphole cross-section area;

Element 2: wherein the at least one moving member fluid opening is radially offset from the at least one fixed member fluid opening;

Element 3: wherein the downhole cross-section area is at least 50% larger than the uphole cross-section area;

Element 4: wherein the downhole cross-section area is at least 200% larger than the uphole cross-section area;

Element 5: wherein the at least one moving member fluid opening is conical in shape;

Element 6: further comprising a second fixed member positioned downhole of the moving member;

Element 7: wherein the moving member is a floating plug, the floating plug having an uphole profile that fits with and seals against a similarly shaped downhole profile of the fixed member fluid opening;

Element 8: wherein the floating plug comprises an elastomer sealing portion;

Element 9: wherein an uphole profile of the floating plug comprises an uphole seal member;

Element 10: wherein the floating plug includes an uphole magnet configured to engage a downhole magnet of the fixed member;

Element 11: further including sensing a rise in pressure within the annulus indicating that the moving member has seated against the fixed member, and thereafter stopping pumping the cement slurry into the annulus;

Element 12: wherein the at least one moving member fluid opening is radially offset from the at least one fixed member fluid opening when the moving member is seated against the fixed member;

Element 13: wherein the moving member is a sliding sleeve and the at least one moving member fluid opening has an uphole cross-section area and a downhole cross-section area, wherein the downhole cross-section area is larger than the uphole cross-section area, and wherein the at least one moving member fluid opening is radially offset from the at least one fixed member fluid opening;

Element 14: wherein the downhole cross-section area is at least 50% larger than the uphole cross-section area;

Element 15: wherein the at least one moving member fluid opening is conical in shape; and Element 16: further comprising a second fixed member positioned downhole of the moving member, wherein the moving member is a floating plug configured to move between the fixed member and the second fixed member, the floating plug having an uphole profile that fits with and seals against a downhole profile of the fixed member fluid opening.

Those skilled in the art to which this application relates will appreciate that other and further additions, deletions, substitutions and modifications may be made to the described embodiments.

What is claimed is:

1. A method for cementing a wellbore, the method comprising:

placing a cementing apparatus within a downhole portion of a wellbore, the cementing apparatus including:

a housing;

a fixed member coupled with the housing, the fixed member having at least one fixed member fluid opening therein; and a moving member positioned downhole of the fixed member and movable between a circulating position and a cemented position, the moving member having at least one moving member fluid opening therein, the at least one moving member fluid opening rotationally or radially offset from the at least one fixed member fluid opening; and pumping cement slurry into an annulus surrounding the wellbore casing until the moving member moves from the circulating position to the cemented position with the moving member seated against the fixed member.

2. The method for cementing a wellbore according to claim 1, further including sensing a rise in pressure within the annulus indicating that the moving member has seated against the fixed member, and thereafter stopping pumping the cement slurry into the annulus.

3. The method for cementing a wellbore according to claim 1, wherein the moving member is a sliding sleeve and the at least one moving member fluid opening has an uphole cross-section area and a downhole cross-section area, wherein the downhole cross-section area is larger than the uphole cross-section area.

4. The method for cementing a wellbore according to claim 3, wherein the at least one moving member fluid opening is rotationally and radially offset from the at least one fixed member fluid opening when the moving member is seated against the fixed member.

5. A well system, comprising:

a wellbore located within a subterranean formation; and a cementing apparatus placed in a downhole portion of the wellbore via a conveyance, the cementing apparatus including:

a housing;

a fixed member coupled with the housing, the fixed member having at least one fixed member fluid opening therein; and a moving member positioned downhole of the fixed member and movable between a circulating position and a cemented position, the moving member having at least one moving member fluid opening therein, the at least one moving member fluid opening rotationally or radially offset from the at least one fixed member fluid opening.

6. The well system according to claim 5, wherein the moving member is a sliding sleeve and the at least one moving member fluid opening has an uphole cross-section area and a downhole cross-section area, wherein the downhole cross-section area is larger than the uphole cross-section area, and wherein the at least one moving member fluid opening is rotationally and radially offset from the at least one fixed member fluid opening.

7. The well system according to claim 6, wherein the downhole cross-section area is at least 50% larger than the uphole cross-section area.

8. The well system according to claim 5, wherein the at least one moving member fluid opening is conical in shape.

9. The well system according to claim 5, further comprising a second fixed member positioned downhole of the moving member, wherein the moving member is a floating plug configured to move between the fixed member and the second fixed member, the floating plug having an uphole profile that fits with and seals against a downhole profile of the fixed member fluid opening.

10. The method according to claim 1, further comprising a second fixed member positioned downhole of the moving member.

11. The method according to claim 10, wherein the moving member is a floating plug, the floating plug having an uphole profile that fits with and seals against a similarly shaped downhole profile of the fixed member fluid opening.

12. The method according to claim 10, wherein the floating plug comprises an elastomer sealing portion.

13. The method according to claim 10, wherein an uphole profile of the floating plug comprises an uphole seal member.

14. The method according to claim 10, wherein the floating plug includes an uphole magnet configured to engage a downhole magnet of the fixed member.

15. The well system according to claim 5, wherein the downhole cross-section area is at least 200% larger than the uphole cross-section area.

16. The well system according to claim 5, further comprising a second fixed member positioned downhole of the moving member.

17. The well system according to claim 16, wherein the moving member is a floating plug, the floating plug having an uphole profile that fits with and seals against a similarly shaped downhole profile of the fixed member fluid opening.

18. The well system according to claim 16, wherein the floating plug comprises an elastomer sealing portion.

19. The well system according to claim 16, wherein an uphole profile of the floating plug comprises an uphole seal member.

20. The well system according to claim 16, wherein the floating plug includes an uphole magnet configured to engage a downhole magnet of the fixed member.

* * * * *